US010820104B2

(12) United States Patent
Colloca et al.

(10) Patent No.: US 10,820,104 B2
(45) Date of Patent: Oct. 27, 2020

(54) DIAPHRAGM, A SOUND GENERATOR, A HEARING DEVICE AND A METHOD

(71) Applicant: Sonion Nederland B.V., Hoofddorp (NL)

(72) Inventors: Michele Colloca, Hoofddorp (NL); Wouter Bruins, Hoofddorp (NL); Wouter Herman Broeze, Hoofddorp (NL); Arno W. Koenderink, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 16/109,416

(22) Filed: Aug. 22, 2018

(65) Prior Publication Data

US 2019/0069091 A1 Feb. 28, 2019

(30) Foreign Application Priority Data

Aug. 31, 2017 (EP) ..... 17188841
Dec. 29, 2017 (EP) ..... 17211118

(51) Int. Cl.

| | |
|---|---|
| ***H04R 25/00*** | (2006.01) |
| ***H04R 7/04*** | (2006.01) |
| ***H04R 7/18*** | (2006.01) |
| ***H04R 11/04*** | (2006.01) |
| ***H04R 7/06*** | (2006.01) |

(52) U.S. Cl.

CPC ..... *H04R 7/04* (2013.01); *H04R 7/06* (2013.01); *H04R 7/18* (2013.01); *H04R 11/04* (2013.01)

(58) Field of Classification Search

CPC ... H04R 7/04; H04R 7/06; H04R 7/18; H04R 11/04

USPC ..... 381/398

See application file for complete search history.

(56) References Cited

U.S. PATENT DOCUMENTS

| | | | |
|---|---|---|---|
| 6,788,796 | B1 | 9/2004 | Miles |
| 6,831,577 | B1 | 12/2004 | Furst |
| 6,853,290 | B2 | 2/2005 | Jorgensen |
| 6,859,542 | B2 | 2/2005 | Johannsen |
| 6,888,408 | B2 | 5/2005 | Furst |
| 6,914,992 | B1 | 7/2005 | van Halteren |
| 6,919,519 | B2 | 7/2005 | Ravnkilde |
| 6,930,259 | B1 | 8/2005 | Jorgensen |
| 6,943,308 | B2 | 9/2005 | Ravnkilde |
| 6,974,921 | B2 | 12/2005 | Jorgensen |
| 7,008,271 | B2 | 3/2006 | Jorgensen |
| 7,012,200 | B2 | 3/2006 | Moller |

(Continued)

FOREIGN PATENT DOCUMENTS

| | | |
|---|---|---|
| EP | 1 878 305 | 10/2006 |
| EP | 3 051 841 | 8/2016 |

(Continued)

OTHER PUBLICATIONS

Extended European Search Report in European Patent Application No. 17188841.5, dated Jan. 8, 2018 (4 pages).

*Primary Examiner* — Phylesha Dabney
(74) *Attorney, Agent, or Firm* — Nixon Peabody LLP

(57) ABSTRACT

A diaphragm with a hinge portion and a drive portion and a plurality of oblong frame portions between the hinge portion and drive portion. The oblong frame portions are able to vibrate independently of each other and may have different resonance frequencies.

17 Claims, 2 Drawing Sheets

(56) References Cited

U.S. PATENT DOCUMENTS

| | | | |
|---|---|---|---|
| 7,062,058 | B2 | 6/2006 | Steeman |
| 7,062,063 | B2 | 6/2006 | Hansen |
| 7,072,482 | B2 | 7/2006 | Van Doorn |
| 7,088,839 | B2 | 8/2006 | Geschiere |
| 7,110,560 | B2 | 9/2006 | Stenberg |
| 7,136,496 | B2 | 11/2006 | van Halteren |
| 7,142,682 | B2 | 11/2006 | Mullenborn |
| 7,181,035 | B2 | 2/2007 | van Halteren |
| 7,190,803 | B2 | 3/2007 | van Halteren |
| 7,206,428 | B2 | 4/2007 | Geschiere |
| 7,221,767 | B2 | 5/2007 | Mullenborn |
| 7,221,769 | B1 | 5/2007 | Jorgensen |
| 7,227,968 | B2 | 6/2007 | van Halteren |
| 7,239,714 | B2 | 7/2007 | de Blok |
| 7,245,734 | B2 | 7/2007 | Niederdraenk |
| 7,254,248 | B2 | 8/2007 | Johannsen |
| 7,286,680 | B2 | 10/2007 | Steeman |
| 7,292,700 | B1 | 11/2007 | Engbert |
| 7,292,876 | B2 | 11/2007 | Bosh |
| 7,336,794 | B2 | 2/2008 | Furst |
| 7,376,240 | B2 | 5/2008 | Hansen |
| 7,403,630 | B2 | 7/2008 | Jorgensen |
| 7,415,121 | B2 | 8/2008 | Mögelin |
| 7,425,196 | B2 | 9/2008 | Jorgensen |
| 7,460,681 | B2 | 12/2008 | Geschiere |
| 7,466,835 | B2 | 12/2008 | Stenberg |
| 7,492,919 | B2 | 2/2009 | Engbert |
| 7,548,626 | B2 | 6/2009 | Stenberg |
| 7,657,048 | B2 | 2/2010 | van Halteren |
| 7,684,575 | B2 | 3/2010 | van Halteren |
| 7,706,561 | B2 | 4/2010 | Wilmink |
| 7,715,583 | B2 | 5/2010 | Van Halteren |
| 7,728,237 | B2 | 6/2010 | Pedersen |
| 7,809,151 | B2 | 10/2010 | Van Halteren |
| 7,822,218 | B2 | 10/2010 | Van Halteren |
| 7,899,203 | B2 | 3/2011 | Van Halteren |
| 7,912,240 | B2 | 3/2011 | Madaffari |
| 7,946,890 | B1 | 5/2011 | Bondo |
| 7,953,241 | B2 | 5/2011 | Jorgensen |
| 7,961,899 | B2 | 6/2011 | Van Halteren |
| 7,970,161 | B2 | 6/2011 | van Halteren |
| 8,098,854 | B2 | 1/2012 | van Halteren |
| 8,101,876 | B2 | 1/2012 | Andreasen |
| 8,103,039 | B2 | 1/2012 | van Halteren |
| 8,160,290 | B2 | 4/2012 | Jorgensen |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman |
| 8,233,652 | B2 | 7/2012 | Jorgensen |
| 8,259,963 | B2 | 9/2012 | Stenberg |
| 8,259,976 | B2 | 9/2012 | van Halteren |
| 8,259,977 | B2 | 9/2012 | Jorgensen |
| 8,280,082 | B2 | 10/2012 | van Halteren |
| 8,284,966 | B2 | 10/2012 | Wilk |
| 8,313,336 | B2 | 11/2012 | Bondo |
| 8,315,422 | B2 | 11/2012 | van Halteren |
| 8,331,595 | B2 | 12/2012 | van Halteren |
| 8,369,552 | B2 | 2/2013 | Engbert |
| 8,379,899 | B2 | 2/2013 | van Halteren |
| 8,509,468 | B2 | 8/2013 | van Halteren |
| 8,526,651 | B2 | 9/2013 | Lafort |
| 8,526,652 | B2 | 9/2013 | Ambrose |
| 10,009,693 | B2 * | 6/2018 | van Halteren ..... H04R 1/02 |
| 2001/0022844 | A1 * | 9/2001 | Urushibata ..... H04R 9/046 381/318 |
| 2002/0142795 | A1 * | 10/2002 | Imahori ..... H04M 1/0202 455/550.1 |
| 2006/0215874 | A1 | 9/2006 | Mekell |
| 2015/0373456 | A1 | 12/2015 | Dayton |
| 2019/0313191 | A1 * | 10/2019 | Sato ..... H04R 7/20 |

FOREIGN PATENT DOCUMENTS

| | | |
|---|---|---|
| WO | WO 2006/105268 | 10/2006 |
| WO | WO 2015/195412 | 12/2015 |

* cited by examiner

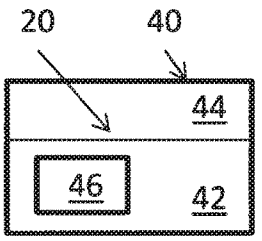
Figure 4
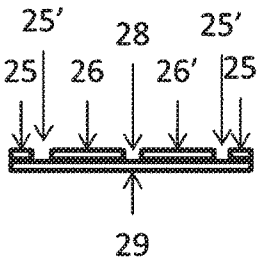
Figure 5
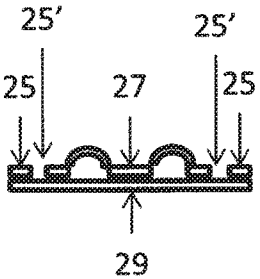
Figure 7
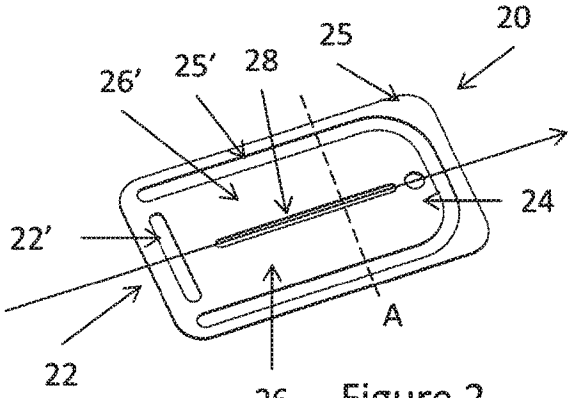
Figure 2
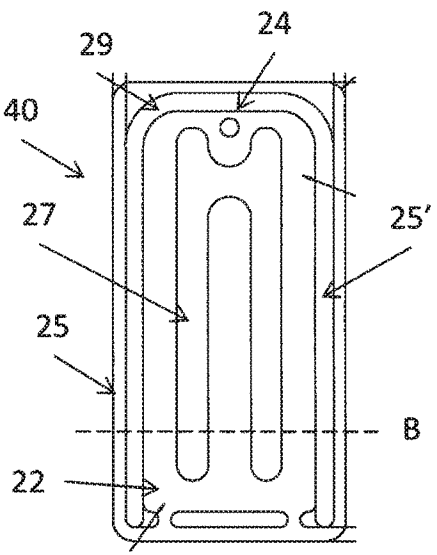
Figure 6
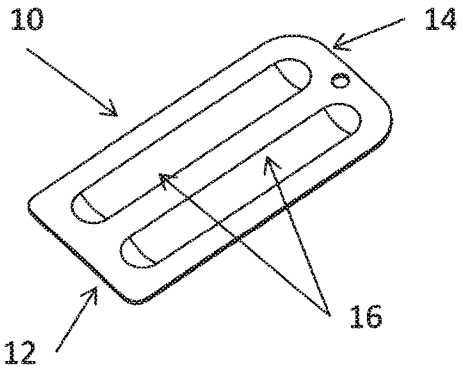
Figure 1, prior art
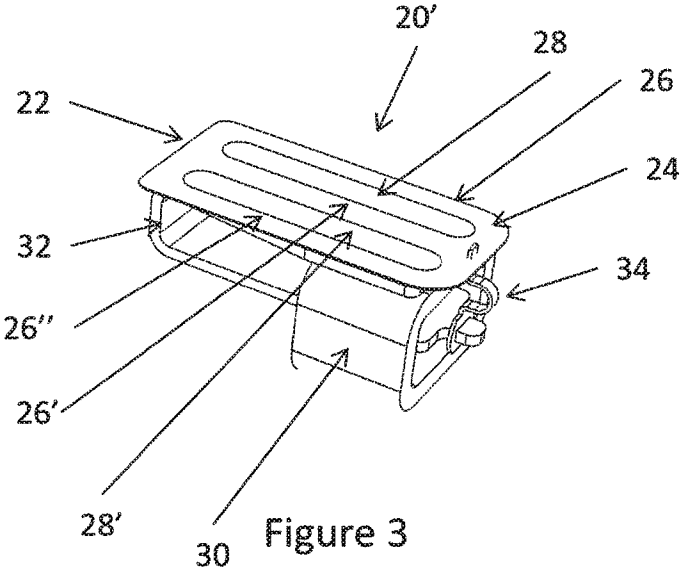
Figure 3

DIAPHRAGM, A SOUND GENERATOR, A HEARING DEVICE AND A METHOD

CROSS-REFERENCE TO RELATED APPLICATIONS

This application claims the benefit of European Patent Application Serial No. 17188841.5, filed Aug. 31, 2017, and European Patent Application Serial No. 17211118.9, filed Dec. 29, 2017, both of which are incorporated herein by reference in their entireties.

FIELD OF THE INVENTION

The present invention relates to diaphragm and in particular to a diaphragm having two individually vibrating parts which may have different resonance frequencies so as to enhance the output intensity at different frequencies.

BACKGROUND OF THE INVENTION

Different diaphragm types may be seen in e.g. WO2015/195412, EP3051841, US2015/373456, US2006/215874 or EP1878305.

In a first aspect, the invention relates to a diaphragm having a hinge portion and a drive portion and a longitudinal direction extending from the drive portion to the hinge portion, the diaphragm having a diaphragm length being a distance from the drive portion to the hinge portion, the diaphragm further comprising a plurality of oblong diaphragm portions each having a length larger than 30% of the diaphragm length, the oblong diaphragm portions being able to vibrate at least substantially independently of each other, the oblong elements directly or indirectly attached to the drive portion and hinge portion.

SUMMARY OF INVENTION

In the present context, a diaphragm is an element which may be used in a sound generator for causing gas movements and thus sound/vibrations and/or in microphones for picking up gas movements and converting these into mechanical movement for the sensing of sound or vibrations.

Usually, a diaphragm is a flat and light element. Sometimes, diaphragms are provided as a single sheet or element and alternatively, the element may be a laminated structure. Diaphragms may be electrically charged if desired.

Diaphragms may be provided with stiffening structures, such as indentations or ridges. Alternatively, the diaphragms may be—or have—flat elements which are able to bend and thus vibrate themselves.

Diaphragms often are hinged at one portion and connected at an opposite portion to a drive. In this manner, the movement of the diaphragm is hinged with a maximum displacement at an opposite end—typically being the drive portion. This drive may be configured to move the diaphragm to generate sound or to receive movements caused by the diaphragm in order to sense sound. Often, the diaphragm is oblong, the longitudinal direction being from the drive portion to the hinge portion.

A hinge may be formed by a resilient element, such as glue, connecting the diaphragm (or a portion thereof) to e.g. a housing or another portion thereof. Alternatively, a hinge may be formed by a portion of the diaphragm itself, such as by weakened portion of the diaphragm. A weakened portion may be a portion of the diaphragm with a lower stiffness, such as a portion of a metal diaphragm provided with slits providing a lower bendability of the hinge portion compared to other portions of the diaphragm between the hinge portion and the drive portion.

The hinge portion may be a portion of the diaphragm extending across a width of the diaphragm (or at least a movable portion thereof; the oblong portions and drive portion), at least substantially perpendicular to the longitudinal axis. Often, a hinge is formed by two or more hinge elements, such as bending or torsional elements, around which the diaphragm may rotate so that the rotation of the diaphragm (portion) takes place around an axis through the hinge elements, usually provided in a plane of the diaphragm. Such bending or torsional elements may extend along the longitudinal direction or at an angle thereto, such as perpendicular thereto.

The diaphragm length is the distance between the drive portion and the hinge portion. The drive portion may be a portion spanning a width, perpendicular to the longitudinal axis, of the diaphragm. The drive portion may alternatively be a portion of the diaphragm configured to be driven, such as an opening for receiving a drive pin or a portion configured to be connected to a motor. The hinge portion may be a portion spanning the width of the diaphragm. Alternatively, the hinge portion may be taken as a position of a hinge or a position between the hinges, if multiple hinges or hinge portions are used.

The diaphragm often is rather plane, even though it may comprise ridges, valleys or the like, such as for stiffening purposes. The diaphragm may define a plane, which may be a plane in which a surface of the diaphragm is provided or in which a majority of the surface is provided, such as portions of the diaphragm other than ridges/valleys.

The drive portion also may be formed by a portion extending across the width of the diaphragm or at least the movable portions thereof.

An oblong diaphragm portion is a portion having a length which is larger than a width thereof, such as in a plane of the diaphragm or diaphragm portion. The length may be more than 1.5, such as more than 2, such as more than 3, such as more than 4 times the width. Naturally, the length and width may be determined as mean values, if a value differs over the diaphragm portion.

The oblong portions have a length of at least 30% of the diaphragm length, such as at least 40%, such as at least 50%, such as at least 60%, such as at least 70% of the diaphragm length. When the oblong portions have a length of this size, the resonance frequencies thereof may be in the audible frequency interval and may thus be helpful in defining the output frequency characteristics of the sound generator.

The vibration behaviour of an oblong element will depend on how the drive portion is driven and where in the diaphragm the oblong element is positioned, as well as the direction of the oblong element. If the oblong element is directed transverse to the longitudinal, the position(s) connected to the drive portion (via other elements of the diaphragm, for example) may be positioned at the same distance to the drive portion, whereas if the oblong element is parallel to the longitudinal axis, the drive position(s) of the oblong element may have different distances to the drive portion.

The oblong elements are attached, typically at their ends, directly or indirectly to the hinge portion and the drive portion. An indirect connection may be via one or more other oblong elements. The driving of the drive portion however will affect or drive all oblong elements.

Usually, the oblong elements are connected at both ends to other elements of the diaphragm but are not at other portions of the oblong element, so that the vibration of the oblong element is a so-called "belly mode" where the central portion may move upwardly and downwardly in relation to the end portions of the oblong element and relatively independently of other portions of the diaphragm.

In one embodiment, at least one oblong element is directed transverse to the longitudinal direction.

In that or another embodiment, at least one oblong element is directed at least substantially along the longitudinal direction.

Each diaphragm portion preferably is connected to the drive portion at one end and to the hinge portion at an opposite end. The diaphragm portions may then be parallel and extend along the longitudinal direction.

In general, one diaphragm portion may bend out of the plane in one direction where another may bend in the opposite direction or not bend at all, without the diaphragm portions touching or hindering the movement between them.

The oblong diaphragm portions are able to vibrate at least substantially independently of each other. In this aspect, vibration may be a longitudinal vibration where a portion of the diaphragm portion bends out of a plane extending through the hinge portion and the drive portion. Thus, the diaphragm portions preferably are positioned so that they, when projected on to a predetermined plane, such as a plane of the diaphragm, do not overlap. In that manner, each oblong diaphragm portion may move out of the plane without risk of contacting another oblong diaphragm portion during vibration.

In one embodiment, an oblong slit is provided between at least two of the oblong diaphragm portions. The slit may separate one oblong diaphragm portion from another and may extend in the longitudinal direction. The slit may have a length exceeding 3, such as exceeding 4, such as exceeding 5, such as exceeding 6, such as exceeding 8, such as exceeding 10 times a width thereof.

In a preferred embodiment, the slit extends a distance of at least 50% of a distance between the hinge portion and the drive portion, preferably at least 60%, 70%, 80% or 90% of that distance. The slit length may define an effective length of a diaphragm portion and thus a resonance frequency thereof.

The slit may be open so that air may penetrate the slit. This, however, may not be preferred, as a diaphragm often is desired to be sealing in order to ensure that as much air as possible is moved, when the diaphragm is moved. Air moving around or through a diaphragm will reduce the efficiency thereof. Often, sound generators and sound detectors have a so-called vent for air pressure equalization across the diaphragm. This vent often is so small that it does not conduct frequencies above 5 Hz, may be provided in the diaphragm and may e.g. be a hole with a diameter in the range of 30-60 μm.

In one embodiment, a resilient element is provided between at least two of the diaphragm portions. This resilient element may prevent air from moving between the diaphragm portions while allowing one diaphragm portion to vibrate or move independently of the other diaphragm portion. In order for the resilient element to not transfer too much of one diaphragm portion's movement to a neighbouring one, the resilient element may be selected with a sufficiently large bendability or stretchability.

The function of the resilient element may mimic that of standard sealing elements for sealing between a diaphragm and a housing or frame of the diaphragm. Thus, the same types of elements, shapes, functions and materials may be used.

The resilient preferably offers a minimum resistance to the membrane movement. Thus, the resilient material preferably has a compliance (quantified in m/N which is the inverse of stiffness, N/m) which is higher, preferably much higher, than the compliance of the diaphragm. Preferably, the compliance of the resilient element is at least one order of magnitude higher than that of the diaphragm. A mechanical compliance has been found suitable in the interval of 0.1-0.0001 m/N is desired, such as in the interval of 0.08-0.0008 m/N, such as 0.07-0.001 m/N, such as 0.05 m/N-0.005 m/N.

Alternatively or in addition, preferably the resilient material is as stretchable as possible. The higher the stretchability of the resilient material, the lower the distortion caused by the resilient material.

Preferably, the resilient element is made of a polymer material, such as PU or PET. Usually, PU can be stretched 50% before breaking.

Naturally, the thickness and other parameters of the resilient material may influence the operation thereof. The density, for example, may be altered by providing the material as a foam, such as a closed foam, which then will often be less dense and thus more resilient (stretchable, bendable and the like) than if provided as a solid material.

Ideally, the resilient material has an infinite compliance (and hence zero stiffness), and the material of the diaphragm and/or oblong elements has an infinite stiffness (and hence zero compliance). However, a stiffer material may be used in order to apply damping to the movements of the portions of the diaphragm.

In one example, the resilient material is PU with a thickness of 0.001-0.1 mm, such as 0.01-0.05 mm, such as around 0.015 mm or PET with a thickness of 0.001-0.05 mm, such as 0.002-0.01 mm, such as 0.004-0.005 mm.

Another type of material useful for use as the resilient material is a gel. Gels combine high damping properties with low stiffness and thus may reduce the peak at resonance frequency to make the resonance frequency peak less sharp and thus alter the corresponding sound to be more pleasant. Reducing the resonance frequency peak will spread the acoustic energy in the "surrounding" frequency range. Thus, the resonance frequencies obtained with the oblong portions may be further manipulated by selecting the resilient material, such as a gel with desired parameters.

Also, the use of a gel may reduce the number of steps in the process of adding the sealing material to the diaphragm. Using a sheet/foil shaped resilient material may require the stretching of the foil and gluing the stretched foil to the diaphragm and, potentially, also making a rib therein. Gels and their use in transducers may be seen in the Applicants co-pending application EP3342749, which is hereby incorporated by reference in its entirety.

The Loss Modulus of the gel or viscoelastic substance may be larger than 1×102 Pa at 1 kHz, such as larger than 5×102 Pa, such as larger than 1×103 Pa, such as larger than 5×103 Pa, such as larger than 1×104 Pa, such as larger than 5×104 Pa, such as larger than 1×105 Pa in order to provided sufficient damping. The Storage Modulus of the viscoelastic substance may be smaller than 1×106 Pa at 1 kHz, such as smaller than 5×105 Pa, such as smaller than 1×105 Pa, such as smaller than 5×104 Pa, such as smaller than 1×104 Pa, such as smaller than 5×103 Pa, such as smaller than 1×103 Pa in order to ensure a low stiffness.

Moreover, the viscoelastic substance could have an impedance in the frequency range of interest of the sensor, for example up to 20 kHz, of at least 100 GΩ, such as at least 200 GΩ, such as at least 300 GΩ, such as at least 500 GΩ, such as at least 800 GΩ, such as at least 1 TΩ, such as at least 2 TΩ, such as at least 5 TΩ in case the viscoelastic substance is applied in a sensor, such as microphone cartridge having a capacitance of around 1 pF.

The resilient element may be provided between neighbouring oblong elements and/or between an oblong element and an outer frame. Thus, the gel may be used in one or both of these positions and a sheet of a resilient material, such as PU or PET may be used in one or both of these positions. In addition, at the hinge portion, a slit may be provided which may again be covered by a gel or a sheet. Any combination may be used.

The gel may be applied in a non-cured state and then cured to become less viscous or more rigid or stiff. The degree of curing and the resulting properties may be adapted to the desired properties of the gel.

A further alternative material for the resilient material is a resin or a mineral filler.

The resilient element may cover a gap between the diaphragm portions between which, apart from the resilient element, a slit as mentioned above may be provided. Thus, the diaphragm portions may vibrate without touching each other.

The resilient material may be provided as a sheet-like element covering only a space between two diaphragm portions or as a sheet covering all of the diaphragm, including the diaphragm portions. The latter is an easier manner of obtaining a diaphragm, even though the diaphragm portions become slightly heavier and the manufacturing may comprise additional steps.

The resilient element may, as the above slit, extend a distance at least 50% of distance between hinge portion and drive portion, preferably at least 60%, 70%, 80% or 90% of that distance.

The diaphragm and/or diaphragm portions preferably are made of a relatively stiff material which preferably is quite light. Metals are often used, such as aluminium, copper, cobalt, iron, nickel, or alloys, such as steel, Nickel-Iron 50-50, Nickel-Iron 80-20, Brass, or metal matrix composite materials, such as an aluminium matrix with ceramic particles therein).

As mentioned above, the diaphragm portions are able to vibrate independently of each other. The diaphragm portions may be desired to have different resonance frequencies. Having a diaphragm or a part thereof resonate at a particular frequency will provide a higher output (sound or signal) at that frequency. Thus, allowing different portions of the diaphragm to have different resonance frequencies will enable the definition of the output of the sound sensor/generator in a new manner.

Being now able to define different resonance frequencies for different oblong portions of the diaphragm enables the tailoring of the output of a sound generator with the diaphragm or of a microphone with the diaphragm.

In typical transducers (microphones or sound/vibration sensors), a number of different elements—as well as the whole transducer as well as parts thereof—will have different resonances. Resonances may be both mechanical and/or acoustical. Often, a so-called drive unit resonance is seen for the whole drive unit (motor, diaphragm and the like) and which usually depends on the total weight of the diaphragm. Often, this resonance frequency is lower than those of the oblong portions.

The multiple oblong elements thus increase the number of resonances and provides the possibility of tailoring the output by positioning these additional resonance frequencies In general, at lower frequencies the most important parameter of a diaphragm often is the surface area or diameter of the diaphragm which there usually simply has a piston-like movement. Thus, the larger the diaphragm surface, the more output, but the size of the diaphragm is limited by the full size of the transducer.

On the other side, at higher frequencies, the diaphragm movement will no longer be piston-like, as the diaphragm may start bending and flexing so that different portions thereof are no longer in phase with each other. This may reduce the overall efficiency of the diaphragm.

According to the invention, multiple oblong portions are provided which may be used for producing resonances and hence extra output at desired frequencies.

If it is desired to enhance speech intelligibility, it is desired to have a higher output in the range of 4-10 kHz and potentially at even higher frequencies.

In order to do so, oblong portions may be designed or selected having resonance frequencies within this range.

As mentioned above, any number of oblong portions may be used, whereby any number of resonance frequencies may be obtained.

A number of parameters of an oblong portion may be adapted or selected to arrive at a desired resonance frequency. The length and width of the oblong portion will affect the resonance frequency, as will the weight and stiffness thereof. Thus, such parameters may be adapted in order to arrive at a desired resonance frequency.

Naturally, the overall extent or outer boundary of the diaphragm (such as defined by inner walls of a transducer) may have to be observed. Thus, it may be preferred that all oblong portions, when projected on to a plane of the diaphragm, do not overlap and are provided within a predetermined outer contour, which may be an outer contour of the diaphragm and/or an inner contour of e.g. a housing or chamber.

Increasing (all other parameters being the same) a width of an oblong portion may have the result of lowering the resonance frequency thereof. Decreasing the width may increase the resonance frequency. Increasing the weight of the oblong portion will decrease the resonance frequency.

The density of the oblong portions, or at least part thereof, may also be selected to arrive at a desired resonance frequency. A less dense material tends to require a higher thickness and thus mass—which again will lower the resonance frequency. The density also may affect the weight which again is a parameter which may be selected to the desired purpose.

In addition, the stiffness of the material or portions of the oblong portions may be selected to arrive at the desired resonance frequency. In general, the stiffer the material, the higher the resonance frequency. Also, for a stiffer material, the diaphragm and/or oblong portions may be made with a lower material thickness which again may reduce the weight. Reducing the weight by reducing the thickness, the stiffness of the oblong portions will fall which again may reduce the resonance frequency. For example, nickel is stiffer than aluminium, so a thinner sheet of nickel may be used. Whether the weight of the oblong portion is reduced depends on the layer thickness, as nickel is denser than aluminium.

As it is, in fact, desired that the oblong portions flex at their resonance frequencies, it may be desired that the oblong portions are plane, such as in a plane of the diaphragm. Other diaphragm types have stiffening bulges or ridges which tend to prevent such flexing.

Different shapes, cross sections, densities, thicknesses, masses, stiffnesses or the like may thus be used for tailoring the oblong portion and/or the resonance frequency thereof.

Thus, different oblong portions may have different resonance frequencies, but it may be desired to have multiple oblong portions with at least approximately the same resonance frequency. Multiple oblong portions may increase the overall output at that frequency, and it may not be possible or desired to provide a single oblong portion with the same output at that frequency.

As a consequence, the oblong portions may be selected and/or dimensioned to have resonance frequencies (both frequency and peak height—and width) tailored to obtain a certain frequency spectrum of a transducer having the diaphragm. As mentioned above, the resonance peaks may also be affected (smoothened) by the resilient element, so even more degrees of freedom exist.

The oblong diaphragm portions may be plane, at least in a rest position, such as in a plane of the diaphragm or so as to have a linear cross section in a plane perpendicular to the longitudinal direction. A plane element may be an element which deviates, in a cross section comprising a longitudinal direction of the element and from a straight line, no more than a distance of 5%, such as no more than 3% of a length of the element in the cross section.

The overall stiffness and thus resonance frequency of a diaphragm portion may also be determined by a curvature of the portion in a plane perpendicular to the longitudinal direction of the oblong portion as well as the cross sectional shape of the curvature (U-shaped, V-shaped, I-shaped, W-shaped or the like). Providing a shape of this type may increase the stiffness without increasing the weight of the portion.

The curved structure may be the above-mentioned ridge or valley which preferably extends in the longitudinal direction so as to impart a stiffness to the oblong diaphragm portion. This curved structure may be provided along the full length of the oblong diaphragm portion or a portion of the length, such as at least 5%, such as at least 10%, such as at least 15%, such as at least 20%, such as at least 30%, such as at least 40%, such as at least 50%, such as at least 75% of the length.

Other manners exist of increasing the stiffness of an oblong element, such as the addition thereto of other elements increasing the stiffness. One example may be to provide the oblong element as a laminate.

Naturally, any number of oblong portions may be provided, such as 2, 3, 4, 5, 6 or more.

One embodiment further comprises an outer frame circumscribing, when projected onto a plane, the oblong diaphragm portions and being connected to the oblong diaphragm portions only at the hinge portion. The oblong diaphragm portions and at least the hinge portion are desirably movable (rotatable) in relation to the frame by being rotatable around the hinge portion. The frame thus may be attached to e.g. a housing so that the other portions of the diaphragm (oblong diaphragm portions and drive portion) may move in relation to the housing.

Naturally, a resilient element, such as of the above described type, may be provided between the outer frame and the outermost oblong diaphragm portions in order to provide an at least substantially gas tight sealing between the outer frame and the oblong diaphragm portions and the drive portion so as to prevent air or gas from escaping from one side of the oblong diaphragm portions to the other.

The outer frame may be manufactured separate from or integrally with the oblong diaphragm portions. The outer frame may be made of another material than the oblong portions. If provided separately, the frame and oblong portions may be attached at the hinge portion so that the oblong portions are rotatable in relation to the frame around the hinge portion.

A second aspect of the invention relates to a sound generator comprising a diaphragm according to the first aspect of the invention, the diaphragm dividing an inner space of the sound generator into at least two compartments.

In this aspect, all embodiments and considerations relating to the first aspect of the invention are equally valid.

In general, the present sound generator and diaphragm may be for use in a hearing aid, hearable, personal hearing device and/or miniature transducer, whereby the dimensions of the diaphragm and sound generator may be extremely small.

In one embodiment, the sound generator is a miniature sound generator, such as a sound generator with a largest dimension of no more than 10 mm, such as no more than 8 mm, such as no more than 6 mm or no more than 5 mm. In one situation, the sound generator housing may have a volume of no more than 100 mm3, such as no more than 70 mm3, such as no more than 50 mm3, such as no more than 30 mm3. Then, the diaphragm may have a longest dimension, such as a longest extent in the longitudinal direction of no more than 10 mm, such as no more than 8 mm, such as no more than 6 mm, no more than 5 mm or no more than 4 mm. in a direction perpendicular to the longitudinal direction, the diaphragm may extend no more than 8 mm, such as no more than 6 mm, such no more than 5 mm, such as no more than 4 mm or no more than 3 mm or 2 mm.

Typically, the diaphragm has the outer frame which may be attached to the housing, such as a wall thereof, in order to fix the frame in relation to the housing and still allow the diaphragm to rotate in relation to the frame and the housing.

Usually, the compartments are called a back chamber and a front chamber, where a sound outlet is provided in the front chamber to allow sound to exit the sound generator to the surroundings. Often, a motor or drive unit is provided, such as in one of the compartments, for driving the drive portion of the diaphragm to move air and thus create the sound.

A third aspect of the invention relates to a hearing device comprising a sound generator according to the second aspect of the invention. In this third aspect, the considerations and embodiments of the above aspects are equally valid.

A hearing device may be a hearing aid for use by a person with impaired hearing. Alternatively, the hearing device may be for use for persons with normal hearing, such as for professional audio use, for standard listening devices, such as ear buds, ear phones or the like.

A fourth aspect of the invention relates to a method of generating sound, the method comprising the steps of:

providing a sound generator according to the second aspect of the invention and vibrating the drive portion.

Naturally, all embodiments and considerations mentioned above are also applicable in relation to this aspect of the invention.

The vibration of the drive portion will bring about a rotation of the oblong diaphragm portions in relation to the housing and thus a generation of sound. This vibration may be caused by a drive unit provided in the sound generator, such as as a result of a signal fed to the drive unit.

A fifth aspect of the invention relates to a method of manufacturing a diaphragm, the method comprising:

providing a sheet of metal, forming from the sheet a hinge portion and a drive portion, forming in the sheet at least two oblong diaphragm portions, each having a length of at least 30% of a distance between the hinge portion and the drive portion, by removing at least a portion of the sheet of metal between the oblong diaphragm portions.

The forming steps may be any type of forming step, such as cutting, laser cutting, stamping, moulding or the like. Naturally, the forming steps may be performed simultaneously, such as in a stamping step. The dimensions, materials etc. described above, in addition to the other embodiments and considerations, are equally valid in relation to this aspect.

A sheet is a metal element having a thickness much lower than the extent in the two directions perpendicular to the thickness direction, such as at least 10 times lower. Often, sheets are plane where the thickness direction is perpendicular to the plane of the sheet.

A metal may be any metal or alloy. Often, the sheet comprises aluminium.

Preferably, as described above, the forming of at least two oblong diaphragm portions comprises forming the oblong portions to extend between the drive portion and the hinge portion.

However, other sizes and directions may be selected as described above.

An outer frame may be provided. The frame may be provided from the same sheet of metal and in the same forming step(s) or from another material and attached to the hinge portion as described below in relation to another aspect of the invention.

A resilient material may be provided between the oblong portions and optionally also the frame. The resilient material may be provided as a sheet covering all of or only part of the frame, the oblong portions and spaces between these elements.

It is noted that, as described above, the hinge portion may be a portion of the diaphragm at which the oblong portions are attached to e.g. a frame. Also, a hinge portion may be obtained using e.g. a weaker portion of the diaphragm created by scoring the diaphragm or providing holes/cavities therein. Alternatively, however, a hinge may also be created by providing resilient material between this portion of the diaphragm and a portion of e.g. the frame. When driving the other end of the oblong portions, the resilient material at the hinge portion will allow the rotation.

A sixth aspect relates to a diaphragm comprising:

a central diaphragm portion having a hinge portion and a drive portion, an outer frame portion circumscribing, when projected on to a plane, at least the drive portion of the central diaphragm portion, the outer frame portion being connected to the central diaphragm at the hinge portion, a plane layer of a resilient material extending from the outer frame portion to the central diaphragm portion, wherein the central diaphragm portion is made of a first material and the outer frame portion of a second material, the second material having a higher stiffness than the first material.

In this aspect, the central diaphragm portion may be a single, unbroken element. Optionally, the central diaphragm portion may comprise oblong diaphragm portions as described above.

The outer frame is made of a material which is stiffer than the material of which the central diaphragm portion is made. A stiffer material often is more dense, and it is preferred that the central diaphragm portion may be made of a relatively light material, such as aluminium or an alloy comprising aluminium (Al).

The frame may be made of a stiffer material, as it is not required to move and so does not have to be light.

A problem encountered when providing the resilient material, which may be a polymer as described above, is that the resilient material may deform the outer frame after having been applied. Often, the resilient material is provided as a layer of the material but only attached to the frame and central diaphragm portion after the formation of the frame and central diaphragm portion. As it is desired that the resilient material layer is straight and not buckled when applied, it is often slightly stretched before/during application/attachment. Subsequently relaxing this stretching results in a biasing force between the central diaphragm portion and the frame. As the frame often is rather thin (in the plane of the diaphragm), this biasing may make the frame buckle, which may render the diaphragm useless or highly inefficient.

Making the frame of a stiffer material will enable the frame to handle the biasing of the resilient material while allowing the central diaphragm portion to be made of a lighter and less stiff material. Often the frame is made of aluminium, copper, cobalt, iron, nickel, or alloys, such as steel, Nickel-Iron 50-50, Nickel-Iron 80-20, Brass, or metal matrix composite materials, such as an aluminium matrix with ceramic particles therein).

A plane layer of a resilient material is a layer which, in a cross section perpendicular to a plane thereof, has a projection which is at least substantially linear and straight. Preferably, the layer has a cross section which deviates no more than 3% of its length, in the cross section, from a straight line from one end of the layer to an opposite end. In this context, the layer is the portion of the resilient material attached to the central diaphragm portion and the frame.

In this context, a resilient material may be that described further above in relation to the former aspects of the invention.

As mentioned above, the attachment of the frame to the central diaphragm portion may be obtained by providing resilient material between these at the hinge portion. This material may be the same material as provided between the central portion and the frame at other positions of the diaphragm. Alternatively, the attachment may an attachment of extending portions of one of the frame and central portion to the other element such as by glue, soldering, welding or the like, to form e.g. bending/torsional hinging.

Naturally, this diaphragm may be used in sound generators and hearing devices as mentioned above.

A seventh aspect of the invention relates to a method of manufacturing a diaphragm, the method comprising:

providing a central diaphragm portion having a hinge portion and a drive portion, the central diaphragm portion being made of a first material, providing an outer frame portion of a second material, the second material having a higher stiffness than the first material, connecting the outer frame portion to the hinge portion so that the outer frame portion circumscribes, when projected on to a plane, at least the drive portion of the central diaphragm portion, and providing a plane layer of a resilient material extending from the outer frame portion to the central diaphragm portion.

Naturally, all embodiments and considerations described above are equally valid here.

The central portion may be provided with or without oblong portions and may be made of a sheet of a metal, such as Al or an alloy comprising Al. The providing thereof may be using a stamping action or by using laser cutting or the like.

The frame may also be provided in a stamping step or from any other process such as laser cutting.

The central diaphragm portion and frame may be made from sheets of suitable materials.

The connection, as described above, may be a soldering, gluing, welding or the like of one or more portions of the central portion to one or more portions of the frame. Alternatively, the connection may be obtained by providing a resilient material between the frame and the hinge portion.

The providing of a plane layer of the resilient material may comprise stretching the layer in order to ensure that it is plane and non-buckled before/during application/attachment.

The attachment of the resilient material to the central portion and frame may be a gluing step, if the resilient material in itself is not sufficiently tacky. The material may be made tacky using e.g. heat, radiation, a solvent or the like. An alternative solution could be a gel, as described above. A gel may be quite simply dosed or provided at the desired positions.

An eighth aspect of the invention relates to a diaphragm element comprising one or more slits covered by a resilient element, the diaphragm element further comprising a damping substance positioned locally on a surface thereof.

In the present aspect, the diaphragm element may be a diaphragm according to any of the above aspects, where a slit may be provided between oblong elements. Alternatively, the diaphragm element may comprise a frame and a standard diaphragm without slits, where a slit is provided between the diaphragm and the frame. Naturally, the diaphragm element may comprise the above slitted diaphragm and a frame.

The diaphragm element may be a sheet or laminate of one or more metals, wherein the slit(s) is/are provided. Naturally, also other materials may be used instead of or in addition to metals.

Naturally, this aspect may be combined with any of the other aspects of the invention, so that all other situations, embodiments and the like may be used in combination with this aspect of the invention.

The resilient element is described above and may be a layer or foil of a resilient material covering the slit or potentially a complete surface of the diaphragm.

The damping substance may be the above-mentioned gel. This substance may be provided on the resilient material in or at the slit and/or on other portions of the diaphragm element. The damping substance may be provided locally, such as as droplets, ridges, lines, tracks, geometrical figures, or the like.

The function of the damping substance is to increase the weight or stiffness of the diaphragm and/or resilient element at the particular position. Thus, the damping material may be used for tuning the diaphragm or particular portions thereof.

The damping material may be cured to have a sufficient stiffness or hardness to remain at the same position even when the diaphragm flexes and moves.

A ninth aspect of the invention relates to a method of manufacturing a diaphragm element, such as a diaphragm element according to the eighth aspect. Naturally, all embodiments, situations and the like from any of the above aspects may be combined with the present aspect.

In one embodiment, the method comprises providing a sheet of a diaphragm material and providing one or more slits therein, then covering the slit(s) with a resilient material, such as by providing a sheet of resilient material covering the slit(s). After that, the damping substance may be provided in one or more positions on the diaphragm material and/or the resilient material. After application of the damping substance, the substance may be cured, such as by heat, radiation, evaporation or the like.

As mentioned, the providing of the sheet of diaphragm material and providing the slit(s) may arrive at a non-slitted diaphragm with a frame or slitted diaphragm as described above, optionally with a frame.

The application step may comprise vibrating the diaphragm or a portion thereof in order to determine one or more positions where damping is desired, and optionally also a degree of damping or an amount of damping substance, and then applying the damping substance at the determined position(s).

Naturally, the damping material may be provided, as mentioned above, as droplets, lines or the like in order to obtain the desired damping.

BRIEF DESCRIPTION OF THE DRAWINGS

In the following, preferred embodiments will be described with reference to the drawing, wherein:

FIG. 1 illustrates a prior art diaphragm having two stiffening portions,

FIG. 2 illustrates a first embodiment of a diaphragm according to the invention, FIG. 3 illustrates a second embodiment of a diaphragm according to the invention connected to a drive unit, FIG. 4 illustrates the main components of a sound generator, FIG. 5 illustrates a cross section of the diaphragm of FIG. 2, FIG. 6 illustrates another type of diaphragm, FIG. 7 illustrates a cross section of the diaphragm of FIG. 6

DETAILED DESCRIPTION OF THE INVENTION

Figure 8:
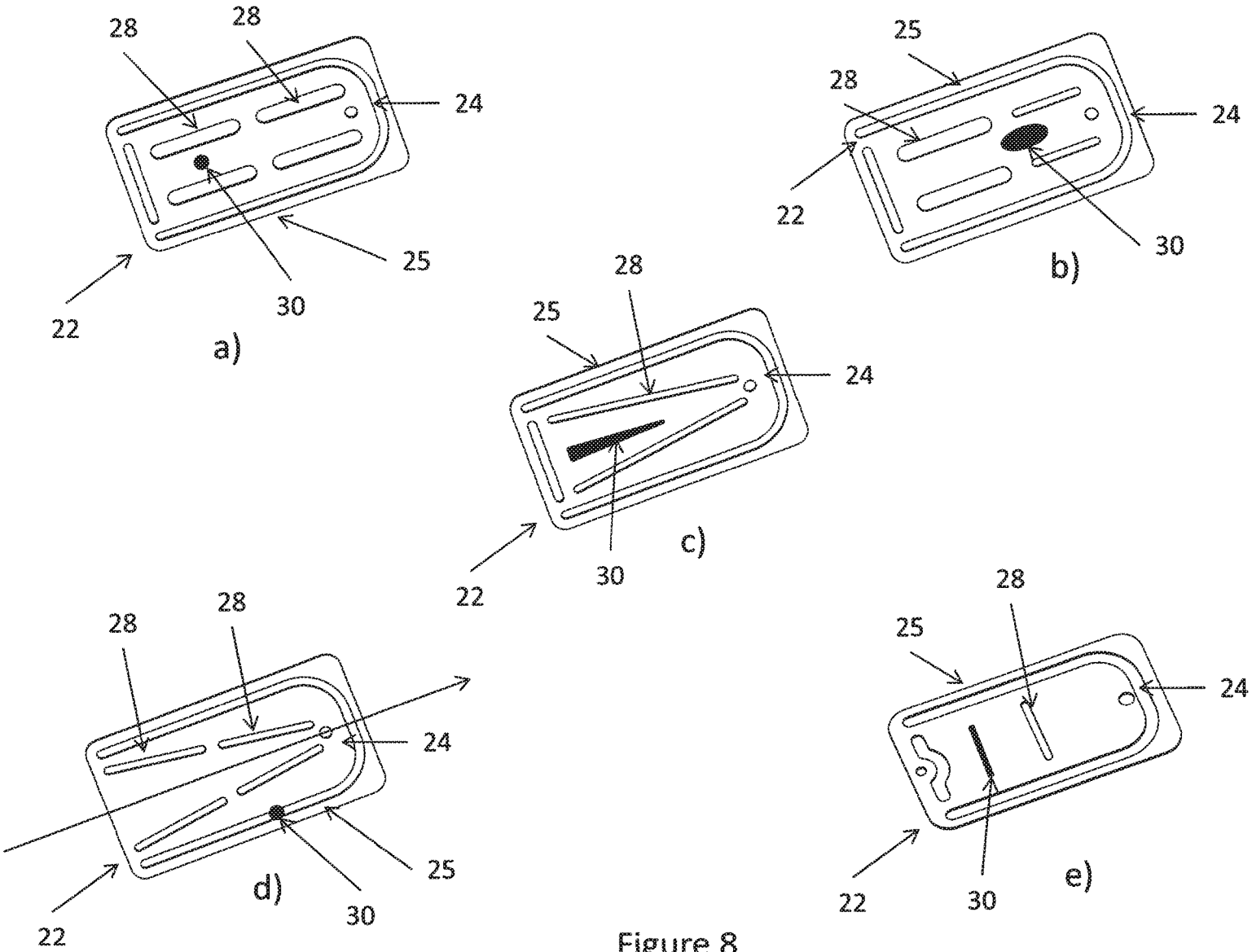
FIG. 8 illustrates a number of other shapes and positions of oblong portions.

In FIG. 1, a prior art diaphragm 10 is illustrated having a hinge portion 12, a drive portion 14 and two ridges 16 providing stiffness to the diaphragm 10.

The operation of the diaphragm 10 is that a motor (not illustrated) will move the drive portion 14 up/down whereby the diaphragm 10 will rotate about the hinge portion 12 which is rotatably fastened to another element, typically a frame and/or the inner surface of a sound generator house.

The ridges 16 impart a stiffness to the diaphragm so that the force applied to the drive portion will move all of the diaphragm. Naturally, the diaphragm will have one or more resonance frequencies defined by the diaphragm parameters.

In FIG. 2, a diaphragm 20 according to the invention is illustrated. It is seen that the diaphragm 20 still has the hinge portion 22 and the drive portion 24 but that the vibrating portion between the hinge portion 22 and the drive portion 24 now has two oblong portions 26 and 26' divided by a slit 28.

Driving the drive portion 24 up/down will still drive the portions 26/26' up/down, but as the portions 26/26' may have different resonance frequencies, the operation of the diaphragm 20 may be different than the prior art diaphragm.

Vibrating a diaphragm will cause the generation of sound/vibration. The output intensity will depend on a number of factors, such as frequency and the resonance frequency/ies of the diaphragm. Generally, the output is higher at a resonance frequency.

Providing a diaphragm with elements with different resonance frequencies allows the generation of a diaphragm with a better and/or more controllable output over the desired frequency spectrum. The oblong elements 26/26' may be "tuned" individually to better create the output desired. An oblong element may be tuned to have a resonance frequency at a frequency where the output would otherwise be lower than desired. Multiple oblong elements make it possible to provide multiple such local output increases in the output spectrum.

Naturally, the portions 26/26' may be more than two portions and may be made of different materials and/or with different parameters, such as different thickness, width, density, material, curvature or the like. A portion 26/26' may be straight or curved (in a plane perpendicular to the longitudinal direction illustrated). A curved cross section may impart a higher rigidity of the portion 26/26'.

In FIG. 2, the diaphragm 20 comprises an outer frame 25 which may be fastened to or in an inner surface of a sound generator to fix the diaphragm 20 while allowing the portions 26/26' and 24 to vibrate around the hinge portion 22, which in this embodiment is formed by two bendable portions at the end of the portions 26/26' and simply created by forming a slit 22' between the portions. Another manner of providing a hinge portion would be to provide the frame and central portion as individual elements and connect these at the hinge portion by a resilient material, such as glue. The slit may, as described below, be covered in order to prevent air or sound passing through the slit.

Usually, a resilient material is provided between the portions 26/26' themselves, i.e. in the slit 28, and between each portion 26/26' and the frame 25, i.e. in the opening or slit 25', in order to ensure an air tight diaphragm.

As is usually the case in diaphragms where the space 25' between the frame and the movable portion of the diaphragm is to be sealed in a manner still allowing movement of the movable portion, it is desired that the portions 26/26' are movable relative to each other. Thus, if a material is provided in the slit 28, so as to seal this opening, it is desired that this material allows one portion 26 to move relative to the other portion 26'.

Suitable materials may be thin sheets of a resilient material, such as PU or PET. Alternatively, a gel may be provided to cover an area or slit. Naturally, any combination may be used, so that the slit(s) 28 between the oblong areas may be covered by a sheet, where the space 25' is covered by a gel, where both are covered by a gel, where both are covered by a sheet, or where the space 25' is covered by a sheet and the slit(s) 28 by a gel. In addition to that, a slit 22' may be covered by a gel or a sheet independently of how the slit(s) 28 and the space 25' is covered.

In FIG. 3, a diaphragm 20' is illustrated having three portions 26/26'/26" defining two slits 28/28' wherein a resilient material is provided for sealing those openings.

In FIG. 3, a drive unit 30 is illustrated having an armature 32 connected to the drive portion 24 via a drive pin 34. In FIG. 3, the outer frame and housing etc. of a sound generator have been left out to better illustrate the driving of the diaphragm.

In FIG. 4, a sound generator 40 is illustrated having the diaphragm 20, a drive unit generally illustrated at 46. As is usual, the diaphragm 20 divides an inner space of the housing into a back chamber 42 and a front chamber 44 having a sound outlet (not illustrated) from which sound may be output.

FIG. 5 illustrates a cross section of the diaphragm 20 of FIG. 2 in a cross section along the line A of FIG. 2. In this cross section, the frame 25 is seen, as are the oblong portions 26/26' and the slit 28. Illustrated is also a layer 29 of a resilient material covering both the spaces between the frame and the portions 26/26' and the slit 28. Thus, an airtight diaphragm may be obtained while catering for the desired operation of the portions 26/26'. An alternative to the layer 29 would be to provide this material only in the spaces between the frame and portions 26/26' and in the slit 28. This would make the portions 26/26' lighter but the manufacturing more complex.

In FIG. 6, another type of diaphragm 40 is illustrated having a central portion 27, having a drive portion 24 and a hinge portion 22, is provided inside a frame 25 and where a resilient material 29 is provided in the space 25' between the central portion 27 and the frame 25 to seal that space. FIG. 7 illustrates a cross section of this diaphragm along the line B.

The diaphragm is driven by moving the drive portion 24 up/down to have the central portion 27 rotate around the hinge portion 22 provided in this embodiment by two extending portions of the central portion 27 which have been attached to the frame 25.

When applying the resilient material 29, it is desired that it is plane and not buckling, as a buckling material could create a range of problems. However, ensuring that the material is plane before attaching to the central portion 27 and the frame 25 will tend to stretch the material 29 and thus to, when applied, have the material 29 generate a biasing of the frame toward the central element 27. This may deform the frame 25, which is not desired.

Thus, the frame 25 is made of a material which is stiffer than that of the central portion 27, which is typically Al or an alloy comprising Al.

The frame 25 may be made of a stiffer material, such as copper, cobalt, iron, nickel, or alloys, such as steel, Nickel-Iron 50-50, Nickel-Iron 80-20, Brass, or metal matrix composite materials, such as an aluminium matrix with ceramic particles therein.

The hinge portion 22 may be obtained by providing the central portion 27 with extending portions which are then fixed to the frame 25, such as by gluing/soldering/welding, or by providing a resilient material between the hinge portion of the central portion and the frame.

Additional manners of providing and shaping the oblong portions are seen in FIG. 8, where, generally, slits 28 are provided as are the frame 25, the hinge portion 22 and the drive portion 24.

In FIG. 8*a*), four slits 28 are provided effectively generating 6 oblong portions. The portions are attached at their ends to the remainder of the diaphragm. The ends of each oblong portion are attached at different distances to the drive and hinge portions.

In FIG. 8*b*), again four slits are made parallel to the longitudinal axis, but now two slits are wider than the other two. Then, the widths of the oblong elements differ from the embodiment in FIG. 8*a*), as may the resonance frequencies.

In FIG. 8*c*), the slits are not parallel to the longitudinal axis. The oblong elements thus have a wedged shape. This again tunes the vibrational behaviour and resonance frequency of the oblong portions.

In FIG. 8*d*), four non-parallel slits are made forming more complex shapes of oblong elements which again may be dimensioned and tuned as desired.

In FIG. 8*e*), the slit 28 is transverse to the longitudinal direction. Again, elements are formed which may be dimensioned and tuned as desired.

In FIG. 8, different positions and shapes of a damping material 30 are illustrated. The damping material may be applied as a droplet, a line, a curve, a geometrical figure, such as a triangle, a square, a rectangle, a circle, an oval, or the like, open or filled with the damping material.

The damping material may be provided at positions where it is desired to increase the mass or the stiffness of the diaphragm. The damping material may be provided on the resilient material 29, in the slits 28 or simply on the diaphragm, such as on an oblong element 26/26', or any combination thereof. In this situation, the diaphragm may comprise a frame 25 and need not have any slits 28.

The damping material may be applied as a gel and subsequently cured, such as dried, heated, irradiated or the like.

The invention claimed is:

1. A diaphragm having a hinge portion and a drive portion and a longitudinal direction extending from the drive portion to the hinge portion, the diaphragm having a diaphragm length being a distance from the drive portion to the hinge portion, the diaphragm further comprising a plurality of distinct oblong diaphragm portions each having a length larger than 30% of the diaphragm length, the distinct oblong diaphragm portions being able to vibrate at least substantially independently of each other, the oblong diaphragm portions extending between the drive portion and hinge portion, wherein the plurality of distinct oblong diaphragm portions, when projected on to the plane of the diaphragm, do not contact one another during vibration of the diaphragm.

2. A diaphragm according to claim 1, wherein at least one of the distinct oblong diaphragm portions is directed transverse to the longitudinal direction.

3. A diaphragm according to claim 1, wherein at least one of the distinct oblong diaphragm portions is directed at least substantially along the longitudinal direction.

4. A diaphragm according to claim 1, wherein each of the plurality of distinct oblong diaphragm portions is connected to the drive portion at one end and to the hinge portion at an opposite end.

5. A diaphragm according to claim 1, wherein an oblong slit is provided between at least two of the distinct oblong diaphragm portions.

6. A diaphragm according to claim 5, wherein a resilient material covers the slit.

7. A diaphragm according to claim 1, wherein a resilient element is provided between at least two of the distinct oblong diaphragm portions.

8. A diaphragm according to claim 1, wherein at least two of the distinct oblong portions have one or more of: different width, different thickness, different density, different curvature, different bendability/stiffness and different resonance frequencies.

9. A diaphragm according to claim 1, further comprising an outer frame circumscribing, when projected onto the plane, the distinct oblong diaphragm portions and being connected to the oblong diaphragm portions only at the hinge portion.

10. A sound generator comprising a diaphragm according to claim 1, the diaphragm dividing an inner space of the sound generator into at least two compartments.

11. A hearing device comprising a sound generator according to claim 10.

12. A method of generating sound, the method comprising the steps of:

providing a sound generator according to claim 10 and vibrating the drive portion.

13. A diaphragm according to claim 1, wherein each of the distinct oblong diaphragm portions is planar and provided in the plane.

14. A method of manufacturing a diaphragm, the method comprising:

providing a sheet of metal, forming in the sheet a diaphragm with an outer diaphragm contour, the diaphragm having a hinge portion and a drive portion, the diaphragm defining a plane across the sheet, forming in the sheet and inside the outer diaphragm contour at least two distinct oblong diaphragm portions extending between the hinge portion of and the drive portion, each having a length of at least 30% of a distance between the hinge portion and the drive portion, by removing at least a portion of the sheet of metal between the oblong diaphragm portions, wherein the at least two distinct oblong diaphragm portions do not contact one another when projected on to the plane of the diaphragm such that any one the at least two distinct oblong diaphragm portions during vibration thereof can move out of the plane without contacting the other or others of the at least two distinct oblong diaphragm portions.

15. A method according to claim 14, wherein the step of forming the at least two distinct oblong diaphragm portions comprises providing the oblong diaphragm portions so as to not overlap when projected on to a plane of the diaphragm.

16. A diaphragm comprising:

a central diaphragm portion having a hinge portion and a drive portion, an outer frame portion circumscribing, when projected on to a plane of the diaphragm, at least the drive portion of the central diaphragm portion, the outer frame portion being connected to the central diaphragm portion at the hinge portion, a plane layer of a resilient material extending from the outer frame portion to the central diaphragm portion, wherein the central diaphragm portion is made of a first material and the outer frame portion of a second material, the second material having a higher stiffness than the first material.

17. A method of manufacturing a diaphragm according to claim 16, the method comprising:

providing a central diaphragm portion having a hinge portion and a drive portion, the central diaphragm portion being made of a first material, providing an outer frame portion of a second material, the second material having a higher stiffness than the first material, connecting the outer frame portion to the hinge portion so that the outer frame portion circumscribes, when projected on to a plane, at least the drive portion of the central diaphragm portion, and providing a plane layer of a resilient material extending from the outer frame portion to the central diaphragm portion.

* * * * *